United States Patent [19]

Ishida

[11] 4,058,933

[45] Nov. 22, 1977

[54] INTERNAL GRINDER

[76] Inventor: Takashi Ishida, 8-21, Gokiso-2-chome, Showa, Nagoya, Japan

[21] Appl. No.: 720,155

[22] Filed: Sept. 3, 1976

[30] Foreign Application Priority Data

Oct. 31, 1975 Japan ..... 50-149215[U]

[51] Int. Cl.[2] ..... B24B 53/02; B24B 49/04; B24B 5/10

[52] U.S. Cl. ..... 51/5 D; 51/165.88; 51/165.93

[58] Field of Search ..... 51/5 D, 165.87, 165.88, 51/165.93

[56] References Cited

U.S. PATENT DOCUMENTS

| | | | |
|---|---|---|---|
| 2,005,332 | 6/1935 | Asbridge | 51/165.87 X |
| 3,155,086 | 11/1964 | Ornehage | 51/165.88 X |
| 3,327,432 | 6/1967 | Lockwood | 51/165.87 |
| 3,760,539 | 9/1973 | Robillard | 51/165.88 X |

*Primary Examiner*—Harold D. Whitehead
*Assistant Examiner*—Nicholas P. Godici
*Attorney, Agent, or Firm*—Jay L. Chaskin

[57] ABSTRACT

A grinding wheel dressing device is mounted, together with a grinding wheel head, on the cut feed carriage, and the grinding wheel head, the grinding wheel dressing device and a direct sizing device which form a group are arranged in a manner to move in the axial direction of the spindle with respect to the head stock, whereby grinding of the inner peripheral surface of a workpiece can be effected.

4 Claims, 6 Drawing Figures

INTERNAL GRINDER

BACKGROUND OF THE INVENTION

This invention relates to improvements in internal grinders.

In one type of internal grinder known in the art, the grinding wheel dressing device is secured to the bed and the grinding wheel head is moved both in the axial direction of the spindle and in a direction which is at right angles to the longitudinal axis of the spindle. In another type of internal grinder known in the art, the grinding head dressing device is secured to the bed, and the grinding wheel head is moved in the axial direction of the spindle, while the head stock is moved in a direction which is at right angles to the longitudinal axis of the spindle. In the former type of grinder, it is possible to mount a direct sizing device on the grinding wheel head side. However, the grinding wheel head must be moved to the position of the grinding wheel dressing device each time dressing is carried out, thereby making the dressing operation troublesome. In the latter type of grinder, a dressing operation can be performed with less difficulty than in the former type of grinder. However, it is necessary to mount a direct sizing device on the head stock side, and thus the direct sizing device must be withdrawn from its operative position each time the worked workpiece is replaced by a new workpiece. Moreover the latter type of grinder has a disadvantage in operation in that a cut operation necessary for effecting grinding of a workpiece must be performed by the operator with his left hand.

SUMMARY OF THE INVENTION

An object of this invention is to provide an internal grinder which obviates the aforementioned disadvantages of the prior art, wherein the grinding wheel dressing device is mounted, together with the grinding wheel head, on the cut feed carriage so as to enable the relative positions of the outer periphery of the grinding wheel and the inner peripheral surface of a workpiece to remain unaltered after dressing of the grinding wheel is effected and to permit the grinding wheel dressing device to move away from the head stock simultaneously as the grinding wheel is moved away from the head stock.

Another object is to eliminate the need to use a special direct sizing device withdrawing device for withdrawing the direct sizing device from its operative position merely by mounting the direct sizing device on the carriage with its feeler being maintained in alignment with the center line of the spindle, and by moving the carriage away from the head stock to release the grinding wheel from engagement with a workpiece when the worked workpiece is replaced by a new workpiece.

Another object is to increase the efficiency with which the internal grinding wheel is operated by mounting the cut feed carriage on the carriage, so that the cut feed of the grinding wheel and adjustments of the relative positions of the workpiece and the grinding wheel which are necessitated when different types of workpieces are handled can be effected by means of the cut feed carriage, whereby the operator can perform a cut operation with his right hand.

A further object is adapt the internal grinder for use in grinding not only through holes but also blind holes and large diameter holes by virtue of the feature that the direct sizing device and the grinding wheel are disposed on the same side, and also to minimize the grinding cycle time by enabling dressing of the grinding wheel to be performed while the workpiece that has been ground is being removed from the spindle.

DESCRIPTION OF THE PREFERRED EMBODIMENT

A preferred embodiment of the present invention will be described with reference to the accompanying drawings.

Figure 1:
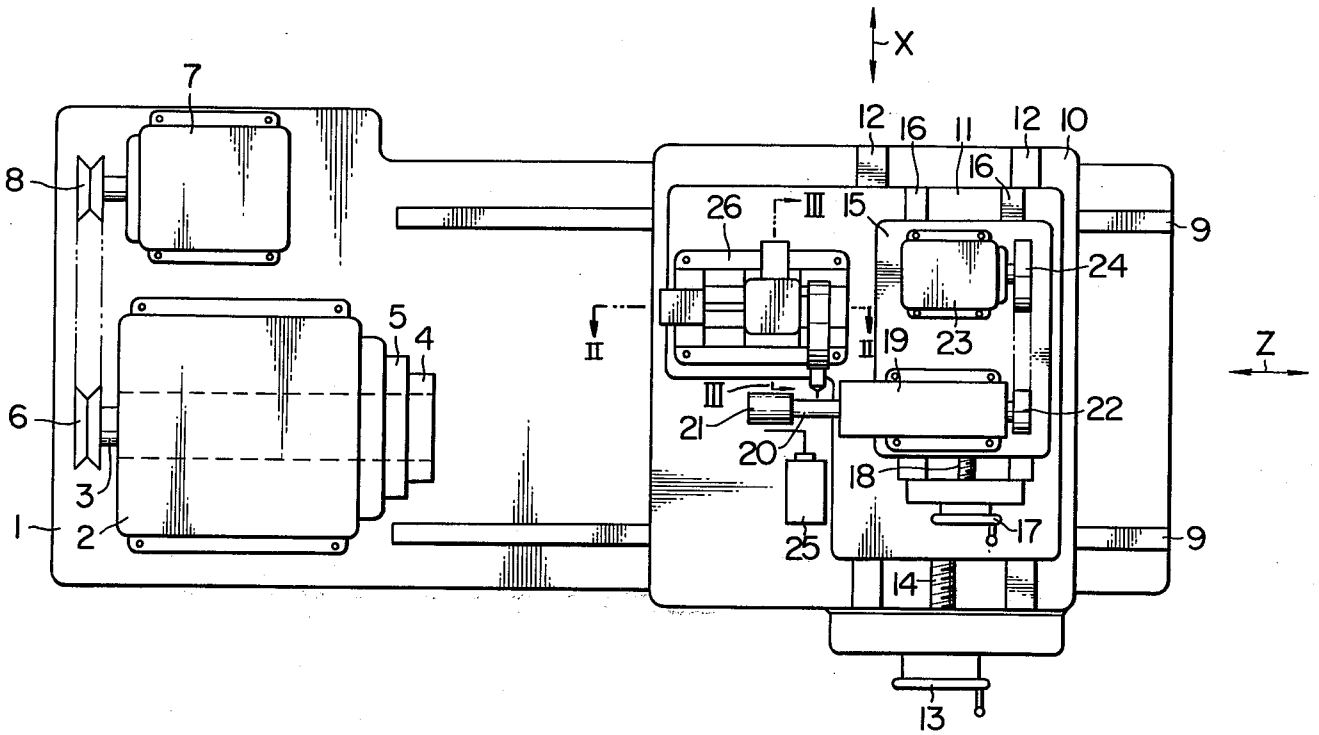
FIG. 1 is a top plan view of the internal grinder comprising one embodiment of the invention.

In FIG. 1, the numeral 1 designates a bed, and the numeral 2 a head stock secured to the left portion of the upper surface of the bed 1. Denoted by the numeral 3 is a spindle rotatably supported by the head stock 2 and having removably attached to its forward end a chuck 5 for gripping a workpiece 4. The spindle 3 has mounted at its rear end a belt wheel 6. The numeral 7 designates an electric motor disposed on the upper surface of the bed 1 and includes a rotary shaft mounting at its forward end a belt wheel 8. An endless belt is trained over the belt wheels 7 and 8.

The numeral 9 designates guide surfaces secured to the upper surface of the bed 1 and oriented in a direction parallel to the axial direction of the spindle 3 or in a Z-axis direction. The numeral 10 designates a carriage which is movable in reciprocatory motion on the guide surfaces 9 in the Z-axis direction. The numeral 11 designates a cut feed carriage adapted to move in sliding motion on guide surfaces 12 which are secured to the upper surface of the carriage 10 and oriented in an X-axis direction or in a direction which is at right angles to the axis of the spindle 3. The numeral 13 is a cut feed handle rotatably mounted on the carriage 10. By turning the handle 13, it is possible to move the cut feed carriage 11 in the X-axis direction through the agency of an externally threaded shaft 14 which rotates with the handle 13 and threadably engages an internally threaded member (not shown) mounted on the cut feed carriage 11.

The numeral 15 designates a grinding wheel dressing correcting carriage adapted to move in sliding motion on guide surfaces 16 which are secured to the upper surface of the cut feed carriage 11 and oriented in the X-direction. The numeral 17 designates a dressing handle rotatably mounted on the cut feed carriage 11. By turning the handle 17, it is possible to move the grinding wheel dressing correcting carriage 15 in the X-axis direction through the angency of an externally threaded shaft 18 which rotates with the handle 17 and engages an internally threaded member (not shown) mounted on the grinding wheel dressing correcting carriage 15. The numeral 19 designates a grinding wheel head mounted on the grinding wheel dressing correcting carriage 15 and supporting a grinding wheel shaft 20 which supports a grinding wheel 21 at its forward end on the side of a chuck 5 and head stock 2 and at its rear end a belt wheel 22. The numeral 23 designates an electric motor mounted on the grinding wheel dressing correcting carriage 15 and includes a rotary shaft supporting at its forward end a belt wheel 24. An endless belt is trained over the belt wheels 22 and 24.

The numeral 25 designates a direct sizing device which tests the dimensions of the internal surface of the workpiece 4, the device 25 being mounted on the carriage 10 in a manner such that a feeler is in alignment with the axis of the spindle 3. The numeral 26 designates a grinding wheel dressing device mounted on the cut feed carriage 11. The grinding wheel dressing device 26 will be described in detail with reference to FIGS. 2 and 3.

Figure 2:
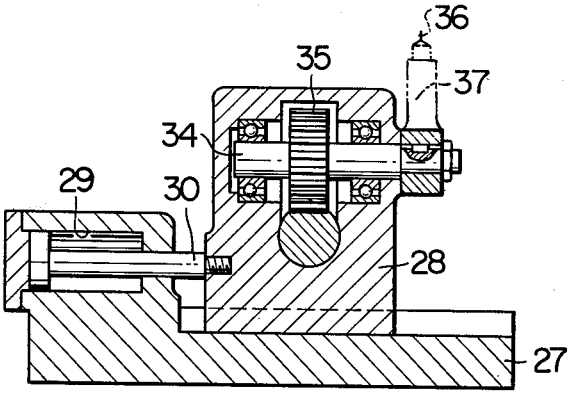
FIG. 2 is a sectional view taken along the line II—II of FIG. 1 of the grinding wheel dressing device used with the internal grinder in accordance with the invention.
Figure 3:
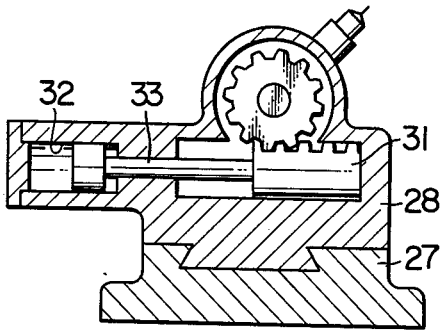
FIG. 3 is a sectional view taken along the line III—III of FIG. 1 of the grinding stone dressing device used with the internal grinder in accordance with the invention.

In FIGS. 2 and 3, the grinding wheel dressing device 26 comprises a fixed base 27 attached to the upper surface of the cut feed carriage 11, and a movable base 28 movable in sliding motion along a guide surface on the fixed bed 27 which is oriented in the Z-axis direction. The movable base 28 is connected to a piston rod 30 of a piston fitted in a cylinder 29 formed as a unit with the fixed base 27. By supplying a fluid under pressure to the cylinder 29, it is possible to move the piston rod 30 connected to the piston so as to move the movable base 28 in sliding motion in the Z-axis direction. The numeral 31 is a rack connected to a piston rod 33 of a piston adapted to move in sliding motion in the X-axis direction in a cylinder 32 formed as a unit with the movable base 28. By supplying a fluid under pressure to the cylinder 32 and moving the piston, it is possible to move the rack 31 in sliding motion in the X-axis direction. The numeral 34 is a pinion supporting shaft extending in the Z-axis direction and supporting at its intermediate portion a pinion 35 adapted to mesh with the rack 31. The pinion supporting shaft 34 has attached to one end thereof an arm 37 which mounts a diamond 36 at its top.

In operation, a fluid under pressure is supplied to the left chamber of the cylinder 32 and moves the rack 31 rightwardly in FIG. 3, so as to move the diamond 36 upwardly to an inoperative position. Then, the carriage 10 is moved toward the head stock 2 and a grinding operation is initiated. During the grinding operation, the feeler of the direct sizing device 25 enters the hole formed in the workpiece to test the inner diameter at all times. If a grinding completion signal is produced by the sizing device or if the grinding wheel 21 is loaded during the grinding operation, then the carriage 10 is moved away from the head stock 2.

In performing dressing, a fluid under pressure is supplied to the right chamber of the cylinder 32 in FIG. 3 to move the rack 31 leftwardly to thereby move the diamond 36 to its operative position. Then, the grinding wheel dressing handle 17 is turned to move the grinding wheel dressing correcting carriage 15 toward the diamond 36. Thereafter, a fluid under pressure is supplied alternately to the left and right chambers of the cylinder 29 in FIG. 2 to move the diamond in reciprocatory motion, thereby carrying out dressing of the grinding wheel 21. At this time, the cut feed handle 13 is not turned at all, so that no change is caused to the relative positions of the outer peripheral surface of the grinding wheel 21 and the inner peripheral surface of the workpiece after dressing of the grinding wheel is performed as compared with the relative positions thereof before dressing is performed. When it is desired to replace the worked workpiece by a new workpiece, it is possible to effect replacements of the workpieces during the dressing operation by moving the carriage 10 away from the head stock 2.

When it is desired to give a cut feed to the grinding wheel 21 during a grinding operation, or when it is necessary to move the grinding wheel 21 a relatively great distance in the X-direction because of a change in the type of the workpieces to be worked, the cut feed handle 13 is turned to accomplish the objects.

Figure 4:
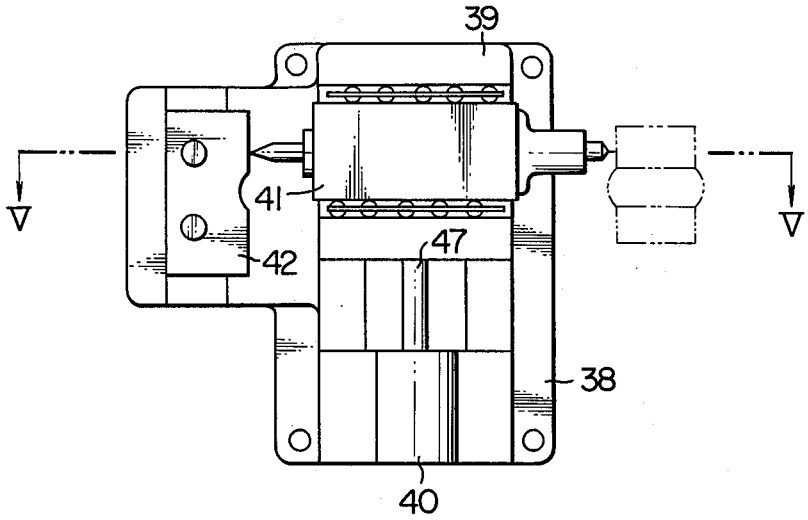
FIG. 4 is a top plan view of a modification of the grinding wheel dressing device for effecting dressing of the grinding wheel to impart a special configuration thereto in conformity with the template.
Figure 5:
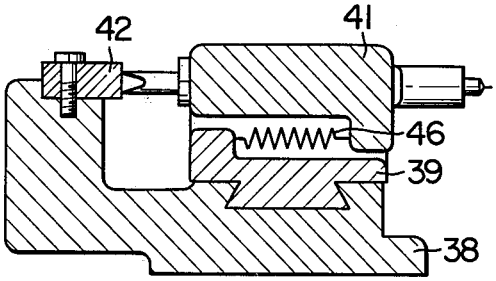
FIG. 5 is a sectional view taken along the line V—V of FIG. 5.

FIGS. 4 and 5 show a modification of the grinding wheel dressing device 26 which is shown as comprising a fixed base 38 secured to the cut feed carriage 11, a movable base 39 adapted to move in sliding motion in the Z-axis direction on the fixed base 38, a cylinder 40 mounted on the fixed base 38 for moving the movable base 39 in sliding motion in the Z-axis direction, and an oscillating member 41 having attached to one end a stylus and to the other end a diamond and mounted for sliding movement in the X-axis direction on the movable base 39. A tension spring 46 is mounted between the movable base 39 and the oscillating member 41 so as to cause the stylus by its biasing force to press against a template 42 bolted to the upper end of the fixed base 38. Thus, by supplying a fluid under pressure to the cylinder 40 to move a piston fitted therein, a piston rod 47 connected to the piston and the movable base 39 causes the movable base 39 to move in reciprocatory movement in the Z-axis direction. This makes it possible to effect dressing of the grinding wheel in a manner such that the shape of the grinding wheel conforms to that of the template 42.

Figure 6:
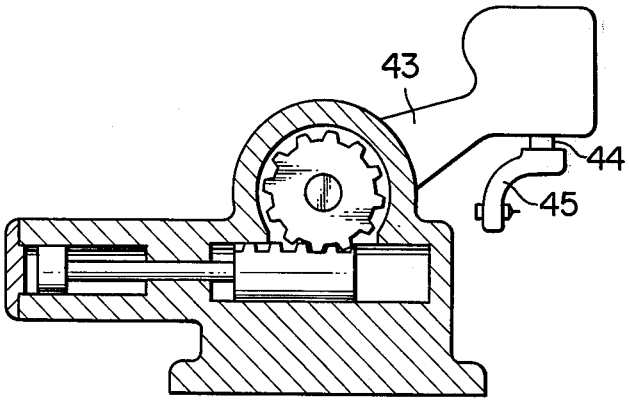
FIG. 6 is a vertical sectional view of a further modification of the grinding wheel dressing device for effecting dressing of the grinding wheel in a manner to impart a rounded configuration thereto.

In FIG. 6, there is shown still another modification of the grinding wheel dressing device 26 which includes an arm 43 which replaces the arm 37 shown in FIG. 2. The arm 43 has at its forward end a revolving shaft 44 which is driven to rotate by a drive (not shown). An arcuate arm 45 is connected at one end thereof to the lower end of the revolving shaft 44 and has a diamond secured to the other end thereof. By this arrangement, the diamond can be moved about the revolving shaft 44, so that it is possible to effect dressing of the grinding wheel in a manner to impart a rounded shape thereto. The modifications of the grinding wheel dressing device which are capable of giving the aforementioned special shapes to the grinding wheel can be used by attaching a known back-off device to the internal grinder. Thus, the internal grinder in accordance with the invention can perform various different types of internal grinding operations.

In the foregoing description of invention, the cut feed handle and the dressing handle have been described as being manually operated by the operator. It is to be understood, however, that the invention is not limited to this embodiment and that the cut feed a carriage and the grinding wheel dressing correcting carriage can be automatically driven without departing from the scope of the invention. Moreover, in the embodiment described above, the head stock is secured to the bed. It is to be understood, however, that the cut feed carriage can be moved in the X-axis direction in sliding motion on the bed by eliminating the carriage and the head stock can be made to move in the Z-axis direction in sliding motion with respect to the bed. Furthermore, the internal grinder in accordance with the invention can be readily made to operate automatically by means of a numerical control system.

I claim:

1. In an internal grinder comprising a head stock supporting a spindle adapted to mount a workpiece and rotate the same, and a grinding wheel head having a rotary shaft oriented parallel to the axis of said spindle in the face of said head stock and adapted to rotatably support a grinding wheel so as to effect grinding of the inner peripheral surface of a workpiece, the improvement comprising a grinding wheel dressing correcting carriage supporting the grinding wheel head and capable of moving in sliding motion in a direction which is at right angles to the axis of said spindle, and a cut feed carriage supporting said grinding wheel dressing correcting carriage and a grinding wheel dressing device and capable of moving in sliding motion in a direction which is at right angles to the axis of said spindle, said grinding wheel head and said grinding wheel dressing device forming a group which is movable in the axial direction of the spindle with respect to the head stock, whereby the internal surface of the workpiece can be ground.

2. The improvement in an internal grinder as claimed in claim 1, further comprising a direct sizing device including a feeler having a forward end fixed at all times in a position in which the feeler is in alignment with the axis of the spindle, said direct sizing device being movable, together with the group consisting of the grinding wheel head and the grinding wheel dressing device, in the axial direction of the spindle with respect to the head stock, whereby the internal surface of the workpiece can be ground.

3. The improvement in an internal grinder as claimed in claim 1, wherein said head stock is fixed.

4. The improvement in an internal grinder as claimed in claim 2, wherein said head stock is fixed.

* * * * *

UNITED STATES PATENT OFFICE

CERTIFICATE OF CORRECTION

Patent No. 4,058,933 Dated November 22, 1977

Inventor(s) Takashi Ishida

It is certified that error appears in the above-identified patent and that said Letters Patent are hereby corrected as shown below:

On The Title Page insert -- [73] Assignee: Okuma Machinery Works Ltd., Nagoya-shi, Japan --.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*